US005801489A

United States Patent [19]

Chism, Jr. et al.

[11] Patent Number: 5,801,489

[45] Date of Patent: Sep. 1, 1998

[54] THREE-PHASE ALTERNATING CURRENT PLASMA GENERATOR

[75] Inventors: Paul E. Chism, Jr., Rte. 7, Box 69, Decatur, Ala. 35603; Hugh W. Greene, West Main St., Somerville, Ala. 35670; Philip G. Rutberg, St. Petersburg, Russian Federation; Alexei A. Safronov, St. Petersburg, Russian Federation; Vasili N. Shiriaev, St. Petersburg, Russian Federation

[73] Assignees: Paul E. Chism, Jr., Huntsville; Hugh W. Greene, Somerville, both of Ala.

[21] Appl. No.: 597,870

[22] Filed: Feb. 7, 1996

[51] Int. Cl.[6] ..... H05H 1/36

[52] U.S. Cl. ..... 315/111.21; 315/111.31; 219/121.36

[58] Field of Search ..... 315/111.21, 111.31; 219/121.36; 250/423 R

[56] References Cited

U.S. PATENT DOCUMENTS

| | | | |
|---|---|---|---|
| 3,849,584 | 11/1974 | Paton et al. | 219/121.36 X |
| 4,009,413 | 2/1977 | Elliott et al. | 315/111.21 |
| 4,013,867 | 3/1977 | Fey | 219/121.36 |
| 4,034,250 | 7/1977 | Kiseler et al. | 313/32 |
| 4,818,836 | 4/1989 | Bebber et al. | 219/121.36 X |

*Primary Examiner*—Robert Pascal
*Assistant Examiner*—Justin P. Bettendorf
*Attorney, Agent, or Firm*—Waddey & Patteson; Mark J. Patterson

[57] ABSTRACT

A plasma generating system uses three electrodes inside a chamber, connected to a low voltage three-phase AC supply. A high voltage AC plasma generator produces an ionized oscillator gas which is injected into the gap between the electrodes. A continuous arc is produced inside the chamber. The arc moves along the electrodes and then superheats and ionizes a working gas which is tangentially injected from a pneumatic ring.

17 Claims, 7 Drawing Sheets

PLASMA GENERATOR SYSTEM COMPONENTS

| CONTACT | TERMINAL BLOCK |
|---|---|
| ○ | XT1 |
| ◑ | XT2 |

THREE-PHASE ALTERNATING CURRENT PLASMA GENERATOR

BACKGROUND OF THE INVENTION

A plasma is generally defined as a state of matter which exhibits the properties of a gas, contains substantially equal numbers of positive and negative charges, and is a good conductor of electricity so that flow can be effected by a magnetic field. Plasma generators are theoretically ideal for a number of special applications such as the glass encapsulation of radioactive materials, the decontamination of pathogenic materials and substances (e.g., hospital waste), and the reduction and/or safe decomposition of hazardous waste or difficult to destroy materials. A benefit of using a plasma generator as a way of reducing or de-composing waste materials is that, if the process can be properly controlled, the resulting end product can be a fuel that can be burned to produce useable energy.

Creating an electric discharge in a working gas to create a plasma is a basic technique that has been researched for many years. Several plasma generation systems have been developed and remain in use today in certain applications, such as the plasma metal cutting torch. Most of the previous work has been in direct current (DC) plasma generators. Prior art DC plasma generation was focused around two basic types: transferred arc and non-transferred arc. In all arc generating systems, the arc is initiated between a cathode and an anode. In a transferred arc system, a substance being treated, a molten metal for example, is used as one of the electrodes. In a non-transferred arc system, the electrodes are independent of the treated substance.

A DC plasma generation system for use in materials cutting is described in U.S. Pat. No. 4,034,250. In this prior art system, the arc burns between the plasma generator and the article to be cut (transferred-arc).

Most DC plasma generators or plasma torches have other drawbacks including a narrow power operating range and an inability to work in a gas which contains hydrocarbons or organic materials. Also, DC plasma generators must use rectifiers and filters in their power supplies, which increases expense while reducing efficiency and longevity.

Although alternating current (AC) plasma generators were thought to be more efficient and less expensive, prior art AC systems were found to be inherently unstable. One source of this instability is the fact that if the arc is pulsed in a single phase system, the arc goes out during each half cycle. Therefore, the arc must be initiated 120 times per second.

What is needed, then, is a plasma generator system that will work with virtually any pure gas, gas mixture, or complex gaseous compound, that will function with very high levels of hydrocarbon vapor or other impurities in the working gas, that produces a stable arc, and that can be easily adjusted over a wide operating range.

SUMMARY OF THE INVENTION

The advantages of the novel plasma generator system are the ability to control the plasma and keep it away from the walls, by the application of rail gun technology, so as to allow a much cooler and more practical mode of operation while allowing extremely high plasma temperatures and providing the increased efficiency gained from an alternating current system.

The system is powered with alternating current directly from a conventional electric utility network or from a generator system. A significant improvement in efficiency is obtained by using alternating current because of reduced losses that would otherwise occur in the power supply. In addition the process of convective heat-exchange takes place because of the rapid movement of the arcs within the chamber, high turbulence gas flow, and diffusion of the arc inside the chamber. The using of relatively low voltage alternating current eliminates the need for an additional high-voltage direct current power supply thus reducing the cost of fabrication and maintenance.

The application of the rail gun effect (the movement of the arc under the influence of its own magnetic field) allows the use the electrodes cooled by water with the operational advantage of several hundreds of hours without maintenance.

The electrodes are designed to channel and flow the plasma by use of its own magnetic field. This is based upon proven rail gun technology. Two types of electrodes can be used: tubular water-cooled electrodes made of copper and rod electrodes made of tungsten alloy and cooled with gas.

The innovative AC system is a non-transferred arc system which is highly stable and offers the flexibility of working much like a gas torch but at much higher temperatures.

This system exceeds the operating characteristics of other plasma approaches due to the highly stable arc. This stable arc is produced by the field which rotates around the three-phase electrode in the same manner as the rotating field in an electric motor. The electrodes are arranged such that the self-magnetic field propels the plasma away from the electrodes in the same manner that a rail (electric) gun propels a mass. The expelled plasma is pseudo-continuous, appearing as a continuous arc. The interaction of the working gas stream in the plasma generator with a constant-burning electric arc (due to time sharing) is the basic phenomenon producing the high-temperature plasma stream.

DESCRIPTION OF THE PREFERRED EMBODIMENT

Figure 2:
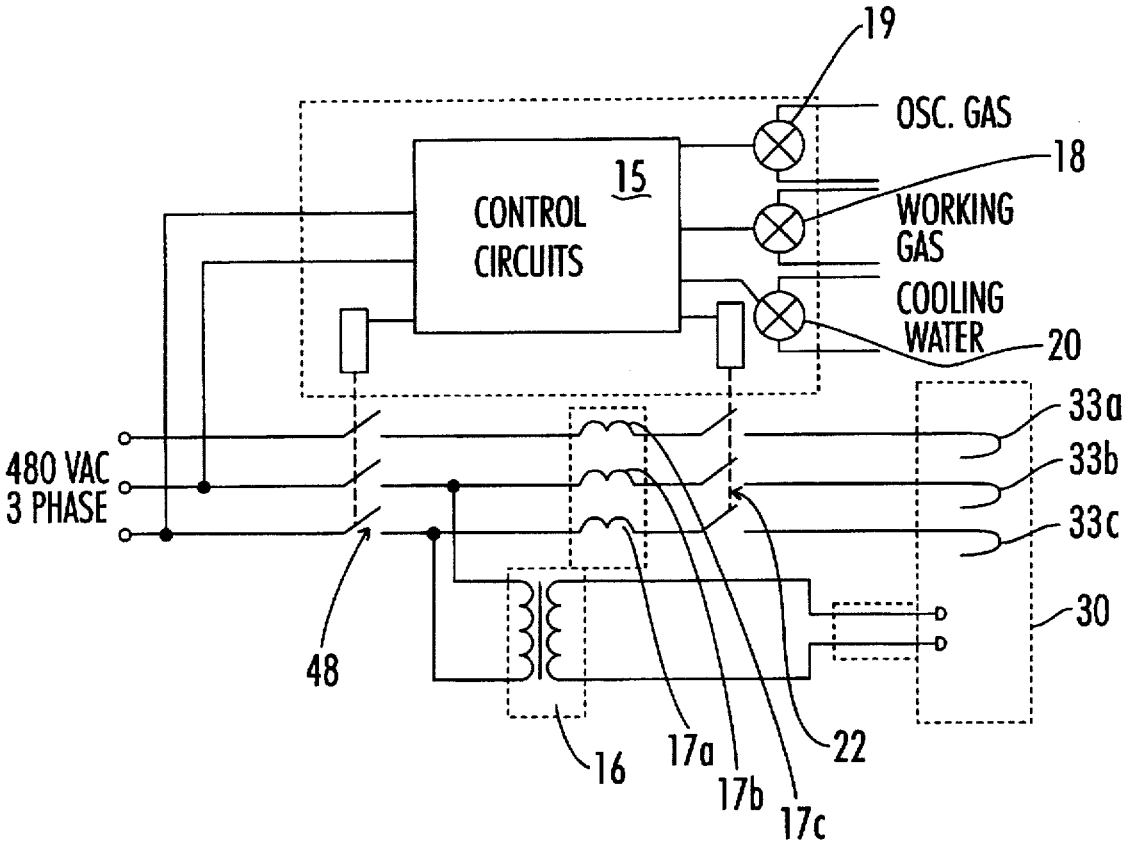
FIG. 2 is a block schematic diagram which generally shows the electrical, water, and gas interconnections among the various components of the system.
Figure 5:
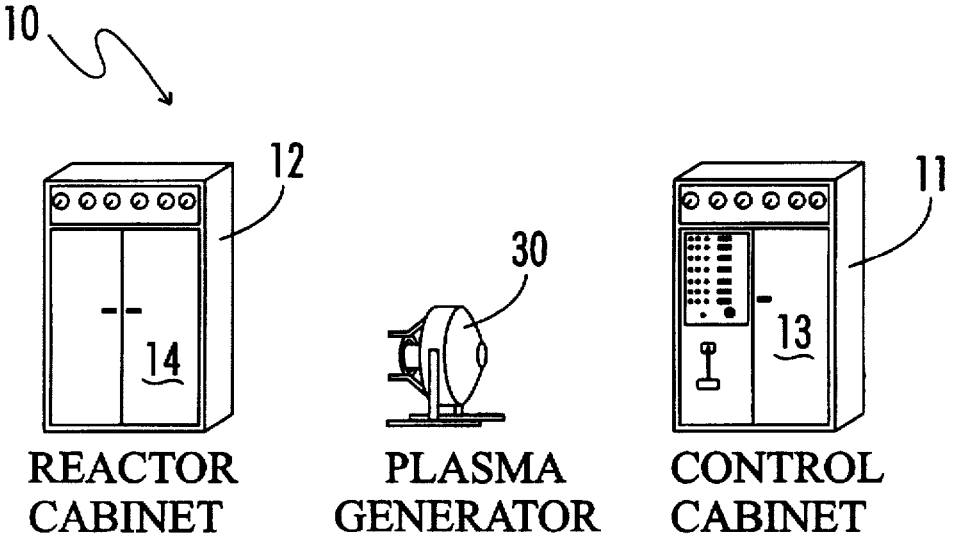
FIG. 5 is a an oblique view of a preferred embodiment of the system showing the separate control, reactor, and plasma generator components of the system.

The general arrangement of the primary components of the plasma generation system 10, and their interconnection, is shown in FIGS. 2 and 5. The plasma generator system comprises three major components: a control unit 11, reactor unit 12, and a plasma generator 30 (FIG. 5).

The control unit 11 contains the control circuits 15 (FIG. 2), main control panel (not shown), power indicator panel (not shown), and oscillator power transformer 16 (FIG. 2). These components are inside a steel control cabinet 13 (FIG. 5) with doors front and back for access to interior components.

The reactor unit 12 (FIG. 5) contains the reactors 17*a, b,* and *c* (FIG. 2), working gas manifold 18 (FIG. 2), oscillator gas manifold 19 (FIG. 2), cooling water manifolds 20 (FIG. 2), and related controls inside a steel cabinet 14 (FIG. 5) with front and rear access doors.

The control and reactor cabinets 13 and 14 (FIG. 5) are preferably mounted together on a common frame (not shown) to provide stability and easy cable routing.

Figure 1:
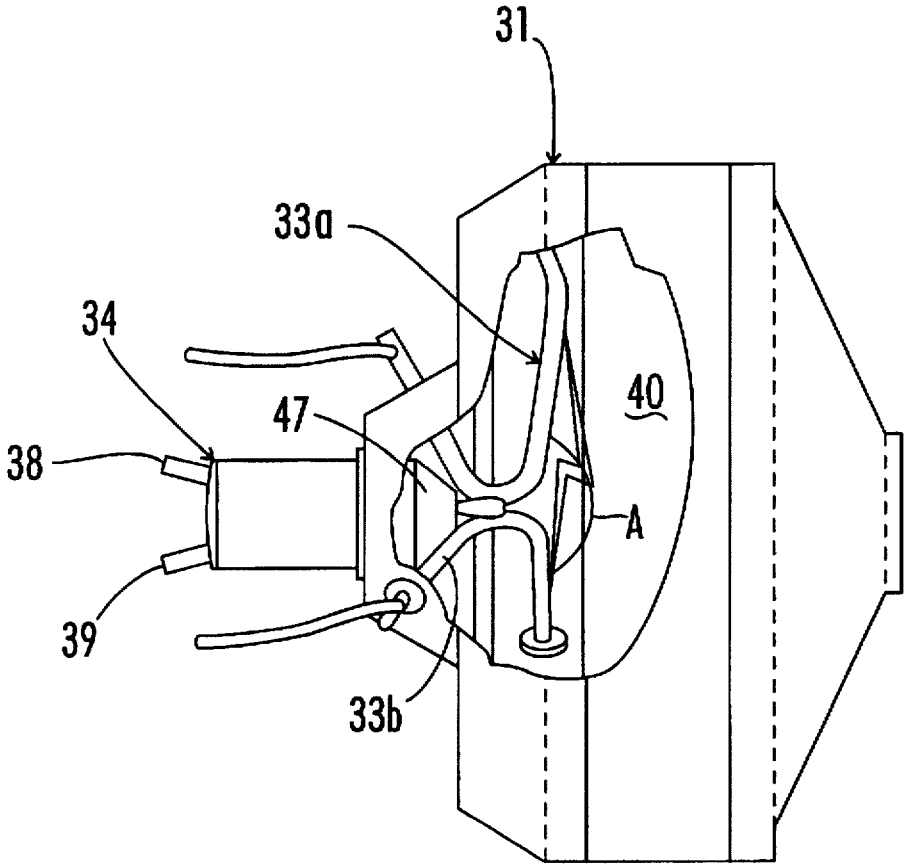
FIG. 1 is a side view of the plasma generator component of the system with the housing partially cut-away to show the interior primary electrodes.
Figure 6:
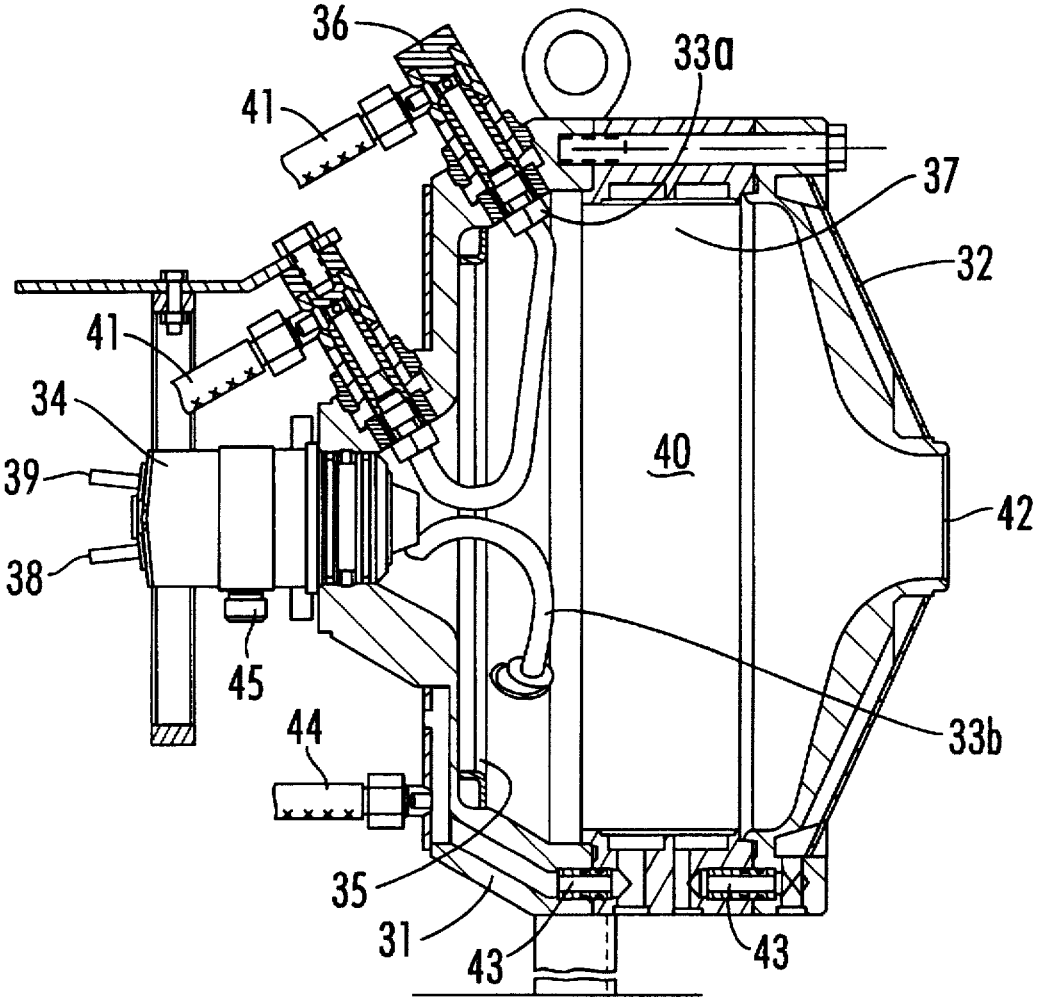
FIG. 6 a cutaway side view of a preferred mechanical embodiment of the high voltage plasma oscillator of FIG. 3.

As seen in FIGS. 1 and 6, and with particular reference to FIG. 6, the plasma generator 30 includes a housing 31 to which or in which are mounted the operative components. High voltage operating power for a plasma oscillator 34 is fed from the secondary of oscillator power transformer 16 (FIG. 2) to first and second oscillator electrode terminals 38 and 39 on oscillator 34 which passes through an end wall of the housing 31. The primary side of oscillator power transformer 16 is connected through an automatic power switch 48 (FIG. 2) across one phase of a 3-phase 480 VAC power network.

The plasma generator housing 31 is actually a shell with an internal water jacket to provide for water cooling. Thus, a faceplate 32 is attached to housing 31 by a spacer ring 37 to form an interior arcing chamber 40 which contains the primary arcs. A circular opening 42 is formed in the center of the faceplate 32 from which the plasma gases are exhausted from within chamber 40. Faceplate 32 and spacer ring 37 also have water jackets in their respective outside walls for cooling purposes. Accordingly, brass tubes 43 having an axial orientation are arranged peripherally around the mating surfaces of faceplate 32 and spacer ring 37 to provide water passages between the water jackets of housing 31, faceplate 32, and spacer ring 37. Cooling water enters the water jacket system through housing cooling water hose 44.

Three primary electrodes 33*a*, 33*b*, and 33*c* (not shown) are spaced circumferentially around the chamber 40 in a wye configuration, i.e., at 120 degree intervals. The electrodes 33*a–c* are powered directly through reactors 17*a*, 17*b*, 17*c* (FIG. 2) which, in turn are connected to separate phases of the 480 VAC 3-phase supply by a contactor 22 (FIG. 2). Preferably, the electrodes 33*a, b,* and *c* are hollow cooper tubes so that they can be cooled Internally by water routed through cooling water hoses 41 (FIG. 6) from cooling water manifold 20 (FIG. 2) in the reactor cabinet 12 (FIG. 5). Insulators 36 (FIG. 6) attach electrodes 33*a–c* to the housing 31 (FIG. 6).

Looking again at FIG. 6, an annular pneumatic ring 35 is welded inside housing 31. The working gas enters the chamber 40 through concentric holes in ring 35. Preferably the holes (not shown) are drilled tangentially so that the working gas is directed to flow in a clockwise direction to create a highly turbulent gas flow, with the relatively cooler gas closer to the walls of chamber 40. In a preferred embodiment, the ring 35 is approximately 9.75 inches in diameter with twelve holes of 0.1 inch diameter. The holes are directed to create the tangential air injection as close as possible to the back wall of chamber 40 so that the gas reaches the electrodes 33*a–c* before the point on the electrodes where the arc is initiated. This arrangement also allows the gas to blow around the electrodes 33*a–c* evenly from all sides.

Figure 3:
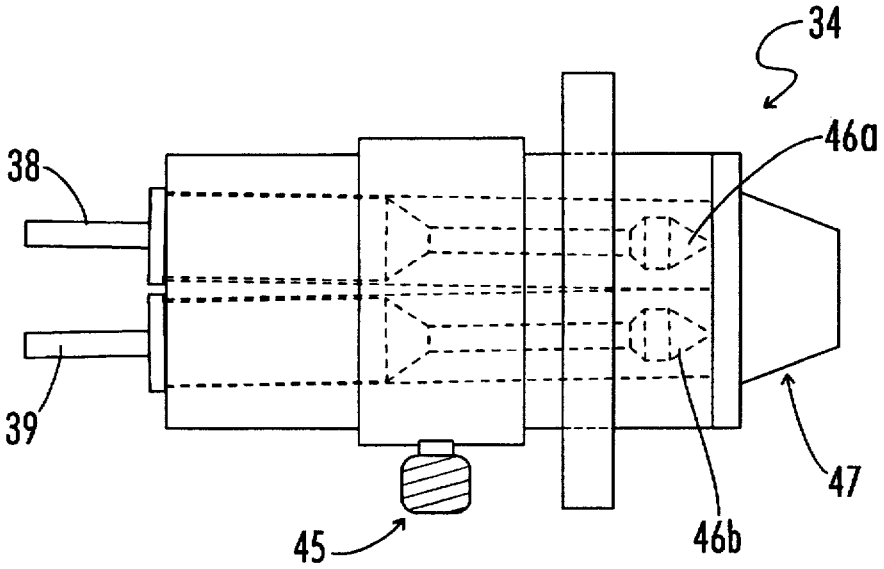
FIG. 3 is an enlarged side view of the high voltage plasma oscillator used in the plasma generator of FIG. 1, with the interior oscillator electrodes shown in phantom.
Figure 4:
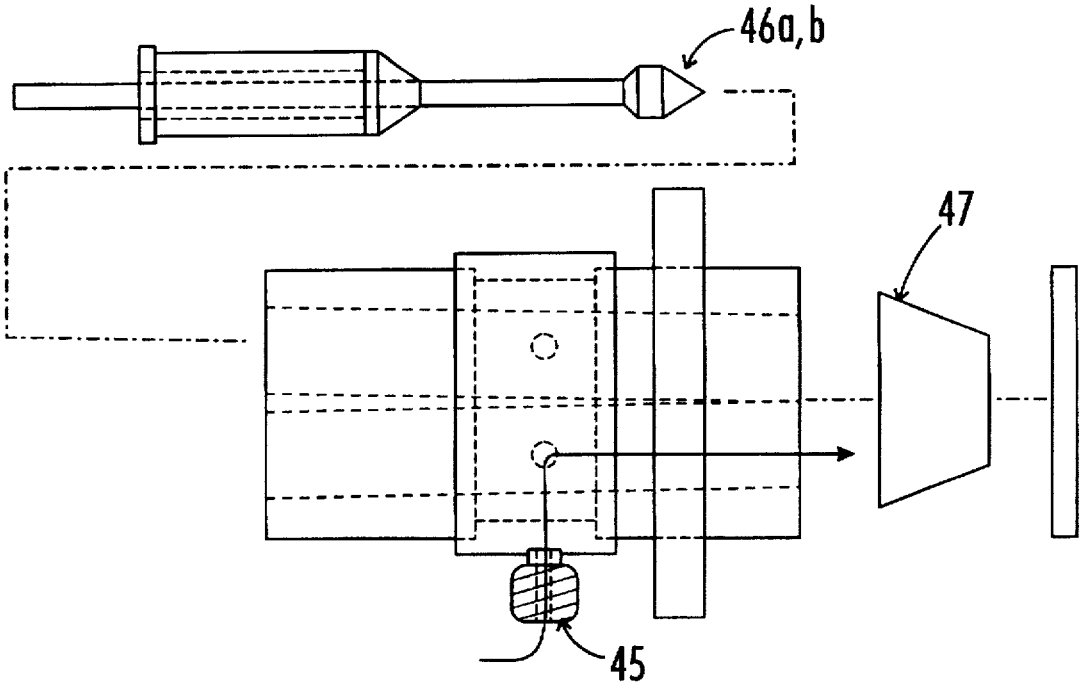
FIG. 4 is an exploded view of the oscillator of FIG. 3.

To initiate an arc from the primary electrodes 33*a–c* inside chamber 40 at relatively low voltages (220–480 VAC), highly ionized gas generated by the high-voltage plasma oscillator 34 is introduced into the gap between electrodes 33*a, b,* and *c*. To obtain the highly ionized gas, oscillator gas is injected into oscillator 34 through gas input 45, passing adjacent the oscillator electrodes 46*a* and 46*b* (FIG. 3). The oscillator gas is supplied through oscillator gas manifold 19 (FIG. 2). The high voltage arc inside oscillator 34 causes the ionized oscillator gas to be expelled out of oscillator nozzle 47 and toward primary electrodes 33*a, b,* and *c*. The presence of the ionized gas causes a breakdown in the gap between the primary electrodes 33*a–c*. The resulting primary arc immediately begins to move along the electrodes 33*a–c* due to electrodynamic movement of the arc in the magnetic field created by its own current (rail gun effect).

The working gas, introduced through the pneumatic ring 35 from working gas manifold 18 (FIG. 2), is then superheated by the arc. Rail gun effect causes the arc to move rapidly along the electrodes 33*a–c*, distributing the heat load. This heat distribution, along with internal water cooling, allows the use of a material for electrodes 33*a–c* having a relatively low melting point but high thermal conductivity, such as copper.

Due to the connection of each primary electrode 33*a, b,* and *c* to a separate phase of the supply voltage, an arc exists continuously inside the chamber 40, with each arc being 60 degrees out of phase as compared to its preceding or succeeding arc. As each arc moves along its corresponding electrode 33*a, b,* or *c*, its length increases, causing the arc voltage to increase. As soon as the voltage reaches the magnitude of the breakdown voltage of the inter-electrode gap in its narrowest place, secondary break-down takes place and the arc becomes self-sustaining. That is, it continues in chamber 40 beyond the region of oscillator gas ionization. This region is filled with the working gas. The working gas is heated by the arc and itself ionizes, contributing to conductance within the arc and allowing it to progress further along the electrodes 33*a–c*. Eventually the gap dimensions become too large to sustain the arc and the arc is extinguished.

This process is repeated with each cycle of input voltage (60 Hz). The velocity of the arc is dependent on the diverging angle between the electrodes 33*a–c* and the magnitude of the arc current. Based on actual measurements of arc velocity along the electrodes 33*a–c*, as the current increases from 150 to 850 amps, the overall velocity changes from 10 m/sec to 25 m/sec.

The arc's actual velocity for a given operating current decreases noticeably as the arc moves along the electrodes 33*a–c*. This is due to the angle A (FIG. 1) between the electrodes 33*a–c* and can be explained by the quadratic decrease of the magnetic field associated with the arc current and with the increase in distance between the electrodes 33*a, b,* or *c* at the point of the arc. Thus, it is preferred that oscillator 34 have sharply diverging electrode angles A. The optimum electrode angle is in part a function of the operating power output of the system 10, as well as the type and flow rate of the working gas. In a preferred embodiment of the system 10, when operating at a maximum power output of one megawatt, the electrode angle A is substantially 170 degrees. The arc working zone of the electrodes 33*a–c* will be approximately 6–7 cm long at an arc working current of 850 A.

The pneumatic ring 35 through which the working gas is introduced forms a whirling stream of gas which fans the arc further, lengthening it to increase arc voltage growth. At the same time, the incoming gas forms a cold layer near the inner walls of chamber 40 which protects them. Thus, power, gas stream temperature, and plasma generator efficiency are regulated by changing the diameter of ring 35 and by varying the number, orientation, and diameter of the holes in the pneumatic ring 35.

The tangential introduction of gas into the plasma generator chamber 40 at an optimal position as described earlier in reference to the electrodes 33*a–c* allows the use of a chamber 40 having a shape that is close to spherical. This spherical chamber design allows more efficiently with a cooling running system. The working gas is injected in a way so that it tends to force the plasma away from the walls of the chamber. The optimum working gas flow rate is between 60–100 cfm.

The system 10 will work with virtually any pure gas, gas mixture, or complex gaseous compound. These include oxidizing (air/oxygen) and reduction (hydrogen) media and the neutral media, such as nitrogen, helium, and argon. The system will also work with very high levels of hydrocarbon vapor in the working gas. Moreover, the main plasma gas supply and the gas to be purified can be the same.

The design of the plasma generator power supply allows it to operate using a common industrial power source (380–480 VAC, 3-phase). The current-limiting reactors 17*a–c* (FIG. 2) should be equipped with taps which allow regulated current selection, resulting in regulation of the plasma generator operating power. In one embodiment of the system 10, the taps on reactors 17*a–c* allow electrode current selection from 100 A to 1500 A.

Depending on the requirements for the high temperature gas stream, a larger system can be designed or several oscillators and plasma generators can be configured to operate into a single volume.

Figure 7A:
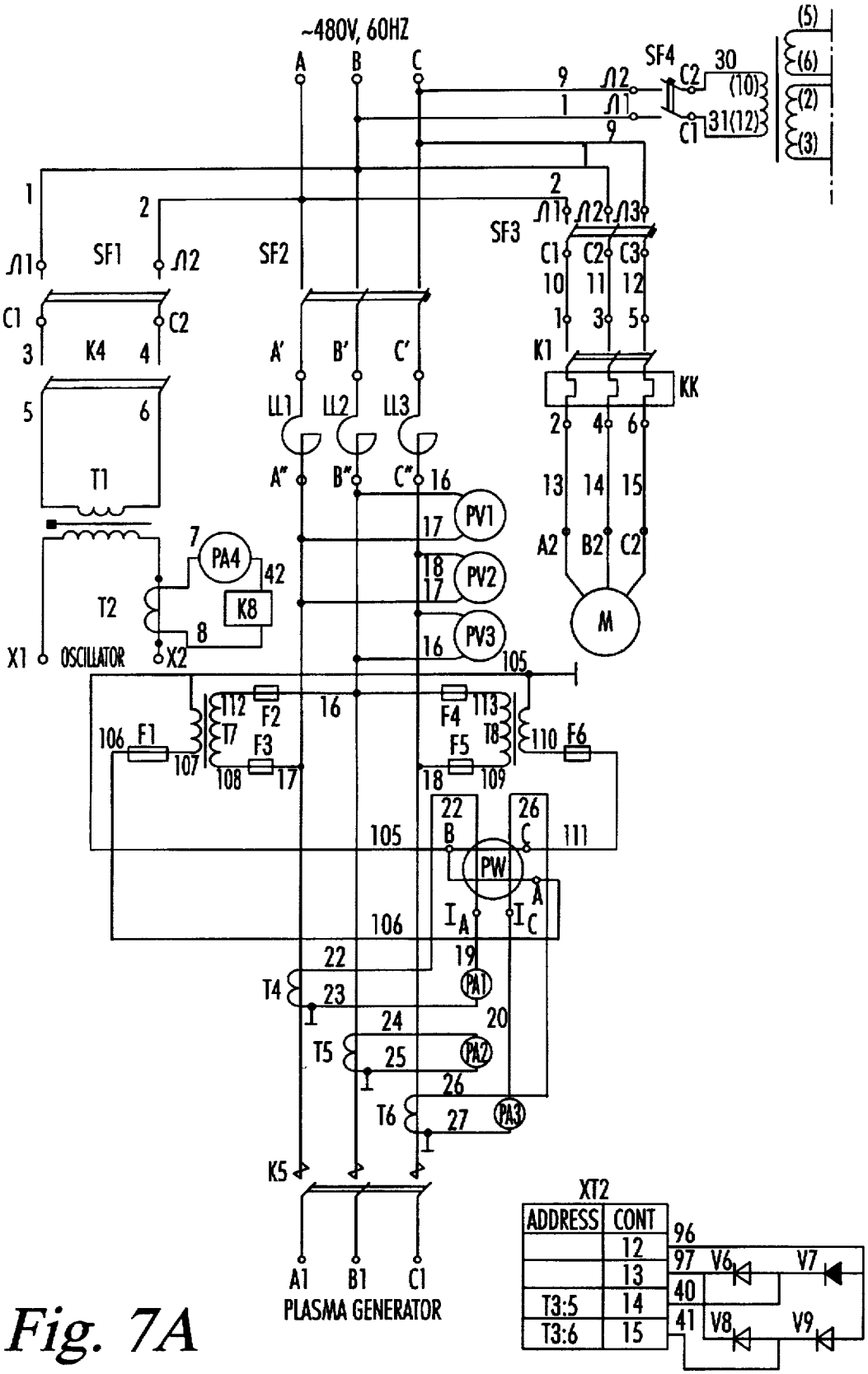
FIG. 7 is a schematic diagram of a preferred embodiment of the control circuits of the system.
Figure 7B:
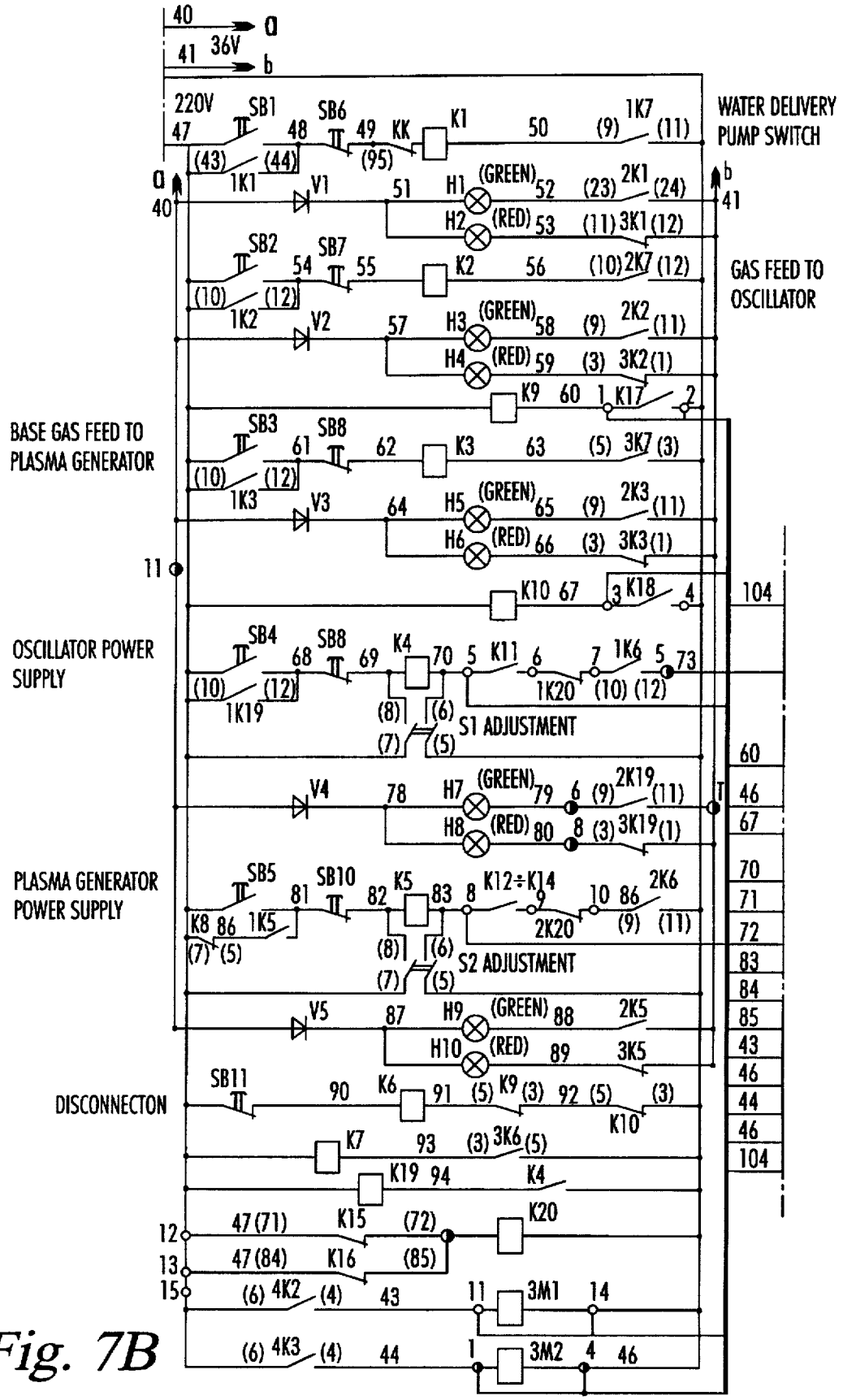
Figure 7C:
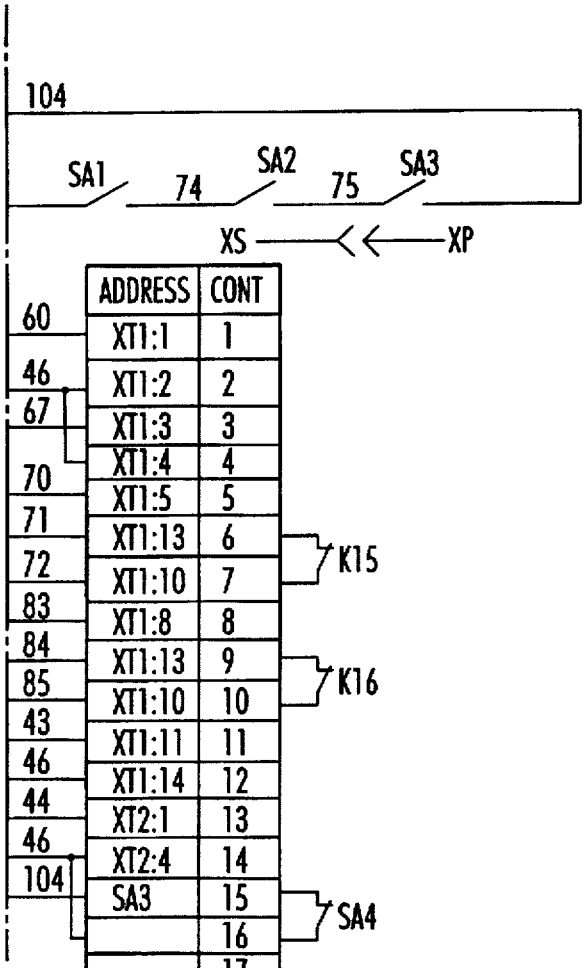

The control system 15 (FIG. 2) provides power, temperature, and gas flow rate regulation, sets the control parameters for plasma generator operation and provides for automatic shutdown if the parameters are exceeded. One embodiment of such a control system 15 is shown in FIG. 7. Operating power (480 VAC, 60 Hz, 3-phase) is connected to points A, B, and C. Switch SF4 applies power from two phases to the primary isolation/step-down transformer T3 from which 36 VAC from one secondary winding is used to power system indicators on control unit 11 (FIG. 5). The other secondary winding on transformer T3 provides 220 VAC for the control circuits.

The indicator lamps H2, 4, 6, 8, and 10 are illuminated through the normally closed (NC) contacts of the control relays K1 through K5. Disconnect relay K6 is energized through the NC contacts of temperature monitoring relays K9 and K10. Thermostats K17 and K18 monitor the temperature of the return cooling water from the plasma generator 30 and reactors 17*a–c* (FIG. 2). Should either temperature pass a preset value, the contacts will close and their associated relay (K9 or K10, respectively) will energize, shutting down the entire system 10. Relay K7 operates through the energized contacts of relay K6. Together, relays K6 and K7 provide a return path for the control switch circuits.

The push button switches SB1 through SB10 operate in pairs with the normally open (NO) switch controlling the "ON" function and the NC switch controlling the power "OFF" function. The system 10 is placed into operation using the 5 pairs of switches SB1 through SB10 in order from top to bottom. Before using the push buttons SB1–SB10, the system 10 should be prepared for operation by placing circuit breakers SF1 through SF4 in the ON position.

Switch SB1 energizes relay K1, sending operating voltage to the electric water pump M, lighting green indicator H1, and extinguishing indicator H2.

Closing switch SB2 energizes relay K2, lighting green indicator H3, and extinguishing indicator H4. Relay K2 energizes valve 3M1 (19 on FIG. 2) sending oscillator gas to the oscillator 34 (FIG. 6).

Closing switch SB3 energizes relay K3, lighting green indicator H5, and extinguishing indicator H6. Relay K3 energizes valve 3M2 (18 on FIG. 2), sending working gas to the plasma generator chamber 40 (FIG. 6).

Pressing switch SB4 energizes relay K4, providing that: relay K11 senses flow in the plasma generator cooling system; relay K20 is de-energized indicating that there is sufficient pressure in both the oscillator and working gas lines; and that door interlocks SA1 through SA4 are closed. Relay K4 sends power to high voltage transformer T1 (16 on FIG. 2) causing an arc between the oscillator electrodes 46*a* and 46*b* (FIG. 3). This arc ionizes the oscillator gas coming from pump 3M1. Plasma in the form of highly ionized gas is now flowing to the gap between the main electrodes 33*a–c*. When relay K4 is energized, it energizes relay K19 providing one of the links in the return path for main contactor K5 (22 on FIG. 2) and switching the lights H7 and H8 from red to green.

Closing switch SB5 energizes main contactor K5 (22 on FIG. 2) provided all conditions are correct: water is flowing at all critical points in the cooling system; gas is flowing to the oscillator 34 (FIG. 6)and plasma chamber 40 (FIG. 6) at sufficient pressure; and the oscillator 34 is energized. Contactor K5 sends power current-regulated by the reactors LL1 through LL3 (17*a–c* on FIG. 2) to the electrodes 33*a–c* in the plasma generator 30 (FIG. 2). The plasma or ionized high temperature gas from the oscillator 34 allows the inter-electrode gap to break down and main plasma generation begins.

Meters PV1 through PV3 indicate voltage and meters PA1 through PA3 display current in each main electrode 33*a, b*, and *c*. Meter PW indicates total average power dissipated in the plasma. Meter PA4 indicates current to the oscillator 34.

Pressing switch SB11 opens relay K6 which removes the return path from K4, K5, and K7. When K7 de-energizes it removes the return path from relays K1, K2, and K3. The system 10 is now shut down.

Because of the novel design of the plasma generator system 10, the system described is able to use almost any gas as the working gas during the plasma generation process. Prior art AC plasma generating systems cannot perform certain tasks because of their inherent instability and because they require a clean or even pure or noble working gas. For example, this system can destroy freon gas, nerve gases, and other military, toxic, and contaminant gases which would be harmful to the environment if released. Because the gas to be treated is also the working gas for the plasma system, there is no requirement for a treatment chamber which is inefficient and can produce less than one hundred percent (100%) material destruction.

The plasma generator described in this invention can also destroy in the chamber aerosols of either a powdered solid or liquid that are introduced into the working gas flow. Accordingly, this plasma generator system can be used to destroy illegal drugs, PCB laden transmission oils, or almost any other solid or liquid that can be converted into an aerosol. Other applications of this plasma generator include the clean up of soil of organic contaminants of the type seen in gasoline spills and the destruction of sludge that may be too contaminated to dispose of in a conventional manner.

Thus, although there have been described particular embodiments of the present invention of a new and useful AC plasma generator, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What we claim is:

1. A system for generation of a high temperature gas stream comprising:

a. a plasma generator unit having a housing, an arcing chamber inside the housing, first, second and third stationary primary electrodes spaced circumferentially around the inside of the housing to define an arcing region between the electrodes within the arcing chamber, and an opening at one end of the housing for exhausting the gas stream;

b. power supply means to connect each of the first, second, and third electrodes to a separate phase of a three-phase alternating current supply voltage;

c. oscillator means to inject an ionized oscillator gas into the arcing region;

d. working gas supply means to deliver a working gas into the chamber; and e. control unit means to control the plasma generator unit, the power supply means, the oscillator means, and the working gas supply means.

2. The system of claim 1 wherein the supply voltage is between 220 and 480 volts.

3. The system of claim 2 wherein the oscillator means comprises a single-phase AC plasma generator attached to the housing and wherein the system further comprises oscillator gas means to deliver oscillator gas into the oscillator means.

4. The system of claim 3 further comprising reactor means to regulate the current to the first, second, and third primary electrodes.

5. The system of claim 4 wherein the housing includes an integral water jacket and the system further comprising cooling water supply means to circulate cooling water through the water jacket.

6. The system of claim 5 wherein the first, second, and third primary electrodes comprise hollow tubes and the cooling water supply means includes means to circulate the cooling water through the tubes.

7. The system of claim 6 wherein the working gas supply means includes an annular pneumatic ring attached to the housing inside the chamber, the ring attached to an external source of the working gas and the ring including a plurality of vent holes through which the working gas can pass from within the ring into the chamber.

8. The system of claim 7 wherein the holes in the pneumatic ring are each arranged and oriented so as to direct the working gas in a consistent swirling rotation to create a turbulent flow of working gas within the arcing chamber.

9. The system of claim 8 wherein the arcing chamber is substantially spherical in shape.

10. The system of claim 9 wherein holes in the ring are tangentially oriented with respect to the ring to direct the working gas proximate a back wall of the chamber.

11. The system of claim 10 wherein each primary electrode forms an angle of approximately 170 degrees with respect to each other primary electrode.

12. A plasma generation system comprising:

a. a plasma generator unit having three stationary primary electrodes, each of the electrodes connected to one phase of a three phase AC supply voltage;

b. an oscillator unit including a pair of electrodes inside the oscillator, the electrodes connected to a single phase AC supply voltage, and means to inject an oscillator gas inside the oscillator;

c. means to inject working gas inside the plasma generator unit near the primary electrodes; and d. means to cool the plasma generator unit.

13. The system of claim 12 further comprising means to cool the primary electrodes.

14. A method of generating a stream of high temperature gas comprising the steps of:

a. applying an AC supply voltage between stationary primary electrodes inside a single arcing chamber;

b. injecting a working gas into the arcing chamber;

c. arranging the arcing chamber and primary electrodes such that the application of the supply voltage across the primary electrodes generates an arc that moves along the electrodes as a consequence of a magnetic field produced by the arc current and such that the moving arc heats and ionizes the working gas, causing the working gas to be expelled from the chamber.

15. The method of claim 14 in which there are three primary electrodes, and in which the AC supply voltage is three-phase, with each primary electrode connected to a separate phase of the supply voltage.

16. The method of claim 15 further comprising the step of injecting an ionized oscillator gas into the arcing chamber proximate the primary electrodes.

17. The method of claim 16 wherein the working gas is injected through holes in a pneumatic ring inside the arcing chamber.

* * * * *